US009209575B2

(12) United States Patent
Garabieta Artiagoitia

(10) Patent No.: US 9,209,575 B2
(45) Date of Patent: Dec. 8, 2015

(54) HIGH-VOLTAGE CONNECTOR

(71) Applicant: ARTECHE LANTEGI ELKARTEA, S.A., Mungia (Vizcaya) (ES)

(72) Inventor: Iñaki Garabieta Artiagoitia, Mungia (ES)

(73) Assignee: ARTECHE LANTEGI ELKARTEA, S.A. (ES)

( * ) Notice: Subject to any disclaimer, the term of this patent is extended or adjusted under 35 U.S.C. 154(b) by 56 days.

(21) Appl. No.: 13/868,569

(22) Filed: Apr. 23, 2013

(65) Prior Publication Data

US 2013/0303030 A1 Nov. 14, 2013

(30) Foreign Application Priority Data

Apr. 24, 2012 (EP) ..... 12382157

(51) Int. Cl.
*H01R 13/53* (2006.01)
*H01R 13/66* (2006.01)
*H01R 24/54* (2011.01)

(52) U.S. Cl.
CPC ..... *H01R 13/6683* (2013.01); *H01R 13/53* (2013.01); *H01R 24/545* (2013.01); *H01R 24/547* (2013.01)

(58) Field of Classification Search
CPC ..... H01R 13/53; H01R 13/6683
USPC ..... 439/676, 797, 801, 813, 921
See application file for complete search history.

(56) References Cited

U.S. PATENT DOCUMENTS 4,661,807 A * 4/1987 Panaro ..... 340/638
4,875,152 A * 10/1989 Foster ..... 363/146
5,225,816 A * 7/1993 Lebby et al. ..... 340/653
5,583,429 A * 12/1996 Otaka ..... 324/127
5,831,425 A * 11/1998 Ochiai ..... 324/117 R
6,031,368 A * 2/2000 Klippel et al. ..... 324/133
6,520,795 B1 * 2/2003 Jazowski ..... 439/475
7,029,327 B2 * 4/2006 Devine ..... 439/587
7,199,571 B2 * 4/2007 Johnson et al. ..... 324/133
7,244,142 B2 * 7/2007 Kato ..... 439/489
7,288,718 B2 * 10/2007 Stepniak et al. ..... 174/74 R
7,316,576 B2 * 1/2008 Saito et al. ..... 439/76.2
7,930,118 B2 * 4/2011 Vinden et al. ..... 702/64
7,930,895 B2 * 4/2011 Kim ..... 62/228.4
8,002,592 B2 * 8/2011 Crutcher et al. ..... 439/783
8,142,237 B2 * 3/2012 Condamin et al. ..... 439/762
8,419,464 B2 * 4/2013 Montena et al. ..... 439/489
2004/0169969 A1 * 9/2004 Takeda ..... 361/42
2009/0079416 A1 * 3/2009 Vinden et al. ..... 324/103 R

FOREIGN PATENT DOCUMENTS

EP 1391740 B1 5/2010
EP 2434583 A1 3/2012

OTHER PUBLICATIONS

European Search Report for corresponding application EP 12 38 2157 dated Apr. 5, 2013.

* cited by examiner

*Primary Examiner* — Neil Abrams
*Assistant Examiner* — Travis Chambers
(74) *Attorney, Agent, or Firm* — Cantor Colburn LLP

(57) ABSTRACT

The high-voltage connector comprises an insulating body (1, 2) with a first internal channel (3) and a second internal channel (4), configured to receive a bushing or a fixed base of a high-voltage equipment. The connector comprises at least one sensor (5, 6, 7, 8) of an electric feature at least partially embedded inside the insulating body.

12 Claims, 2 Drawing Sheets

HIGH-VOLTAGE CONNECTOR

CROSS REFERENCE TO RELATED APPLICATION

This application claims the benefit of European Patent Application Number 12382157.1 filed on Apr. 24, 2012, the contents of which are herein incorporated by reference in their entirety.

TECHNICAL FIELD OF THE INVENTION

The invention is encompassed in the field of high-voltage T-format or elbow insulated connectors.

BACKGROUND OF THE INVENTION

"T" format connectors for high voltage are used to connect cables to the bushing or fixed base of the connection to a high voltage equipment, for example, for voltages between 7 and 367 kV. "T" format connectors have, as indicated by their name, a shape resembling a T with a hollow interior, comprised by an initial hollow stretch or internal channel running through the "vertical" portion of the T, which is joined to a second hollow stretch or internal channel in a position between the two ends of the second internal channel, preferably in a central area or substantially central area of the second internal channel. These internal channels, formed in the body of the connector, communicate with one another, that is to say, the first internal channel leads into the second internal channel, thus forming an internal hole substantially in the shape of a T. The first internal channel can receive or host a cable, for example, an insulated single-line conductor cable, so that this cable may be connected to a conductor element introduced through one of the ends of the second internal channel, or to two conductor elements, each one of them introduced through the corresponding end of the second stretch, through a high-voltage terminal located in the connector. This way, a cable housed in the first internal channel can be connected to a bushing introduced through one of the ends of the second internal channel, and in addition to another element introduced through the other end of the second internal channel. The body of the "T" format connector is at least partially made from insulating material, so the body of the connector has an external portion that is electrically insulated from the holes and internal components.

It may be desirable to be able to verify installation parameters, for example, the connection voltage or the currents flowing therein. For this reason, the installation of current and voltage sensors in correspondence with the cable connections to high-voltage equipment is known. For this purpose, European patent EP-B-1391740 proposes a system in which a current sensor (in the shape of a ring with coils wrapped around a magnetic material) is placed around the bushing or fixed base (through which the current must pass) and a voltage sensor placed in the opposite end of the second internal channel (vertical stretch) of a T format connector. This way, the voltage sensor can enter into contact with the connector's internal high voltage terminal, which is in contact with the cable (going up through the connector's first internal channel) and with the one which enters into contact with the bushing entering through the first end of the second internal channel. This and similar solutions have been used and are conventional in this sector.

DESCRIPTION OF THE INVENTION

It has been considered that solutions such as the one described in EP-B-1391740 may imply certain inconveniences, even when they are satisfactory from the point of view of measurement quality most of the time. For example, the location of the voltage sensor inside the second internal hollow channel prevents this hole from serving for the connection to other elements (that is to say, the second end of this second internal channel is "blocked") and the presence of the current sensor around the bushing may complicate its use. In addition, the fact that the sensors are external to the T connector implies a certain risk of complications due to interaction or interference with other external elements. In addition, the connector manufacturer has no control whatsoever over the way in which the sensors will be positioned when their connector is about to be used.

The invention relates to a high-voltage connector, for example, in T format (for example, for voltages higher than or equal to 7 kV and lower than or equal to 36 kV), said connector comprising an insulating body (which is at least partially composed by insulating material and which may have been obtained by moulding by injection of an insulating material) with a first internal channel (which may be extended axially through a first portion of the insulating body, which may be T-shaped; in this context, the term channel implies a hollow space inside the insulating body that may receive or house an element, for example, a conductor element, such as an insulated cable in the case of the first internal channel) with a first end and a second end, and a second internal channel (which may extend axially through a second portion of the insulating body, passing through it from one end to the other in the case of a T format connector) with a first end and, in the case of T format connector, also with a second end, and said first end of the second internal channel being configured to be coupled with or to receive a bushing or a fixed base of a high-voltage equipment. The first internal channel leads into the second internal channel in correspondence with its second end, for example, in the case of a T format connector between the first end of the second internal channel and the second end of the second internal channel, for example, in a position substantially half way between these two ends.

According to the invention, the connector comprises at least one sensor for measuring an electric feature partially or totally embedded inside the insulating body. A measurement sensor is understood as a sensor serving to actually measure the value (exact or approximate) of said electric feature, for example, the value of the voltage at one point or the flowing current, and not the type of sensor merely serving to detect the presence of voltage but not to measure its value.

This way, with the sensor embedded inside the insulating body, not only a compact device is achieved, but also a controlled location of the sensor or sensors, thus reducing the risk of an unforeseen interaction between the sensor and elements external to the sensor, or between the sensor and the connector's own elements. In addition, there is no need to place voltage sensors in the hole of the second internal channel, so that said hole is free for other applications. In addition, there is no need to place a current sensor around the bushing. In addition, the connector's manufacturer may have total control over the manufacturing and configuration not only of the connector per se, but also of the sensor elements and their location and orientation, thus reducing the risk of errors due to an inappropriate incorporation of sensor elements. In addition, once embedded inside the insulating body, the position of every sensor may be perfectly defined and the risk of errors due to unforeseen displacements is reduced.

Said at least one measurement sensor may comprise at least a current sensor, for example, a coil-shaped current sensor (for example, a Rogowski coil) surrounding the second internal channel and/or a coil-shaped current sensor (for example, a Rogowski coil) surrounding the first internal channel.

Alternatively, or complementarily, said at least one measurement sensor may comprise at least a voltage sensor, for example, a voltage sensor comprising at least one resistive or capacitive element, or comprising at least two resistive or capacitive elements. The voltage sensor may be connected to a connection terminal (for example, a high voltage connection terminal) located inside de connector, for example, in the junction between the first internal channel and the second internal channel, for example, a high-voltage terminal to establish a connection between a cable or an electric conductor entering through the first internal channel, and a bushing entering through one of the ends of the second internal channel.

The sensor or sensors may be embedded inside the insulating body as a result of a manufacturing procedure of the insulating body by moulding, for example, by injection moulding.

The insulating body may be made from, for example, ethylene-propylene-diene monomer rubber (EPDM).

The sensor or sensor may have at least one connection point or low-voltage terminal, for example, positioned in an external surface of the insulating body or accessible from said surface, to connect the sensor or sensors to one or more devices external to the connector.

Generally, there are two high-voltage cells in the transformation stations, in which the connections are made with T format connectors. Elevated currents (of the order of 400 amps) flow through the lines from which the connectors come out. A third cell serves for the connection to the transformer, and lower currents (lower than 200 amps) flow therein. Elbow connectors are usually used in the latter type of cell. It is especially desirable to measure the voltage and/or the current from the lines coming out/entering from/in the two first cells and less interesting to measure these parameters at the connection with the transformer having the elbow connector. Therefore, the invention has been conceived especially for T format connectors, although it also may be applicable to elbow connectors.

BRIEF DESCRIPTION OF THE FIGURES

In order to supplement the description and with the purpose of facilitating a better comprehension of the characteristics of the invention according to several preferred practical embodiment examples, this specification is accompanied by a set of figures in which, by way of illustration and not by way of limitation, the following is represented.

PREFERRED EMBODIMENT OF THE INVENTION

Figure 1:
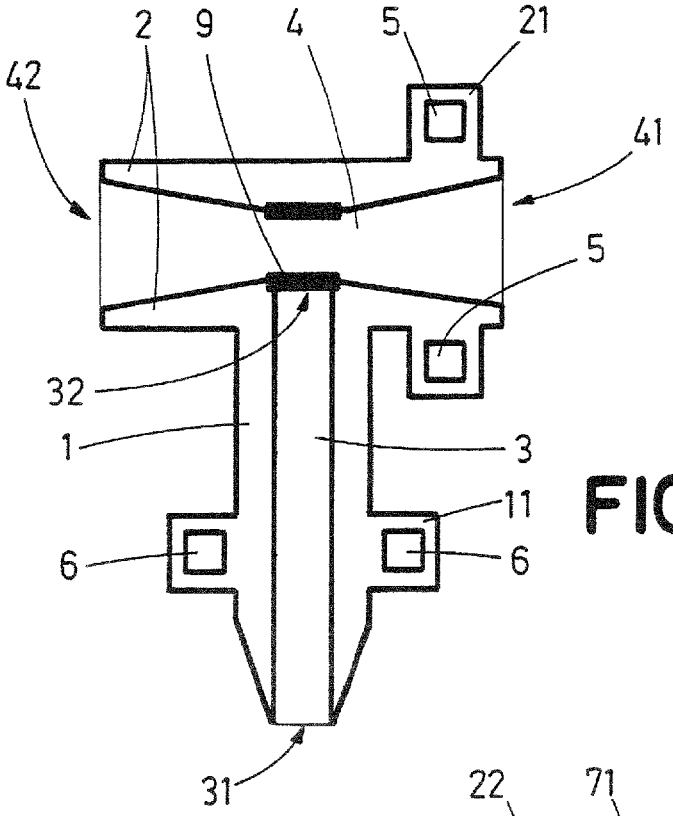
FIGS. 1 and 2 are schematic elevation and section views of T format connectors according to two possible embodiments of the invention.

FIG. 1 schematically illustrates a T-format high-voltage connector with an insulating body comprising a vertical portion 1 and a horizontal portion 2, which both are part of the same monobody moulded by injection moulding. In addition, the connector may comprise other conventional elements, such as, for example, shielding elements, semiconductors, contact terminals, etc., as is common in the field. The body is substantially in the form of a "T", with its vertical 1 and horizontal 2 sections positioned at right angles.

As it can be seen in FIG. 1, inside the insulating body there is a first internal channel 3 extending through the first portion 1 of the insulating body, having a first lower end 31 and a second end 32. This first internal channel may house an insulated electric cable entering through the first extremity 31 and extending towards the second end 32, where it may be connected to a high-voltage terminal 9. On the other hand, at the second portion 2 of the connector, namely, at the portion corresponding to the horizontal portion of the T, there is a second internal channel 4 passing through said second portion between a first end 41 and a second end 42. The second end 32 of the first internal channel 3 leads into the central portion of the second internal channel 4. Both internal channels are configured as axial orifices extending through the aforementioned vertical portion 1 and the aforementioned horizontal portion 2, respectively. The connector is configured so that, when a bushing is introduced into the second internal channel through one of its ends 41, 42, the bushing is electrically connected to the cable through the high-voltage terminal 9. In other embodiments of the invention, the T format connector does not have a terminal 9, but instead, the connection cable entering the first end 31 may, for example, comprise an electric bar having an orifice in which a threaded rod is assembled, to which the bushing is subsequently screwed.

The moulded monobody is made up by insulating material, so that the external surface of the connector is insulated from the internal hollow channels housing the conductor elements (including the bushing, cable and terminal).

FIG. 1 shows how the insulating body 1, 2 has two coil-shaped current sensors 5, 6 (for example, toroid-shaped coils, such as a Rogowski coil) in its interior, surrounding the second internal channel 4 and the first internal channel 3, respectively, to allow measuring the current flowing through the bushing and the cable, respectively. In many cases, having only one of these two sensors may be enough. The sensors may be connected to connecting points or low-voltage terminals (not shown) to interconnect the sensors with instruments external to the insulating body.

Figure 2:
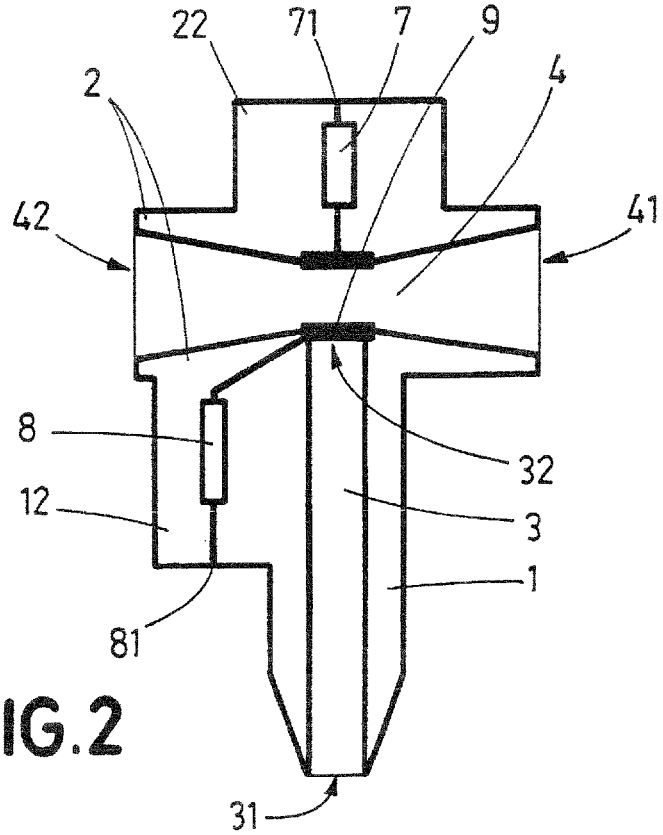

FIG. 2 illustrates a variant in which the sensors are voltage sensors, represented by two resistive or capacitive elements 7, 8, which are connected between the respective low-voltage terminals or contacts 71, 81 on the surface of the insulating body and the high-voltage terminal 9, and may serve to measure the voltage at the high-voltage terminal.

Logically, the same insulating body may include one or more voltage sensors and one or more current sensors. These elements may be housed inside the insulating body when the body is produced in a mould, for example, by injecting the insulating material, for example, EPDM.

This way, a compact T format connector integrating the necessary sensors is achieved, so that only connecting it to the corresponding equipment or instrument is needed to carry out the measurements.

As shown by FIGS. 1 and 2, sensor elements 5, 6, 7, 8 are housed inside certain areas or portions 11, 12, 21, 22 of the insulating body 1, 2, which extend from the basic T configuration of said body. This may be necessary or convenient to maintain appropriate distances between the sensor elements and the conductor parts of the connector, or the cable and the bushing, and to maintain the appropriate insulation characteristics of the insulating body despite the presence of sensor elements 5, 6, 7, 8.

Figure 3:
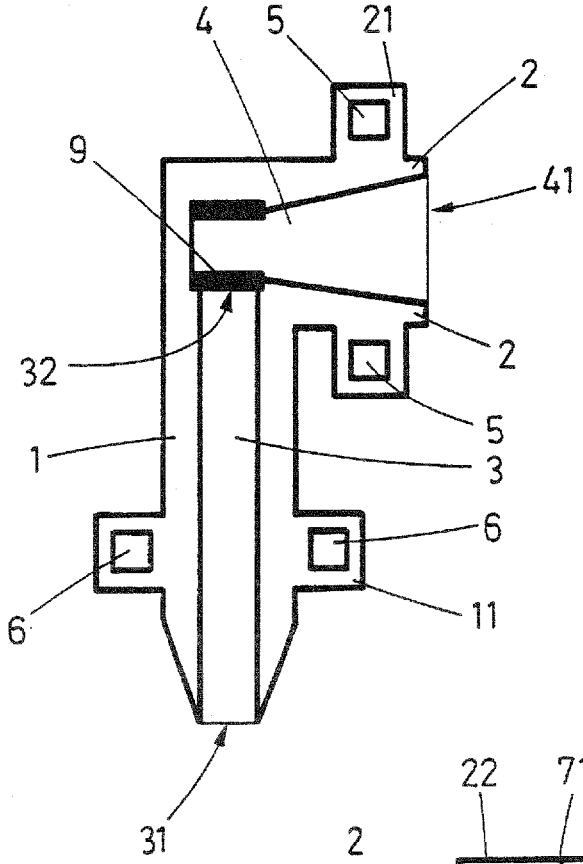
FIGS. 3 and 4 are schematic elevation and section views of elbow connectors according to two possible embodiments of the invention.
Figure 4:
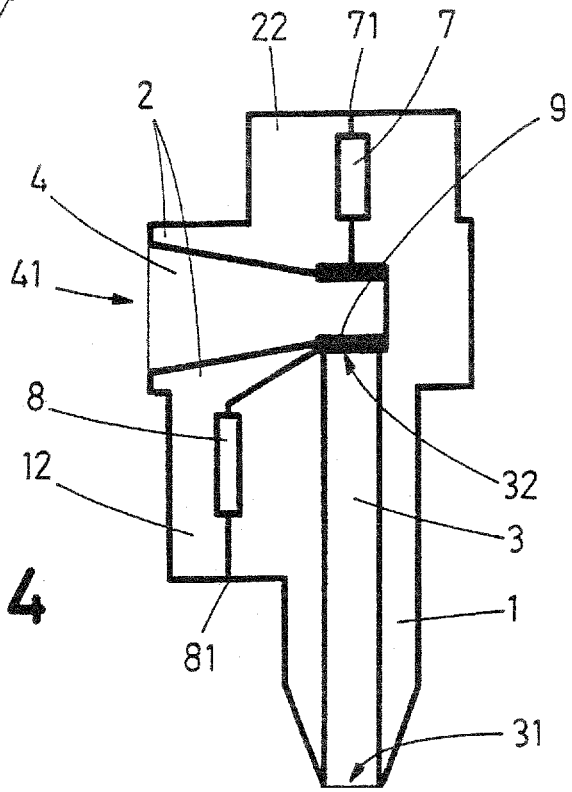

The invention may also be applied to elbow connectors; FIGS. 3 and 4 show two possible embodiments of such elbow connectors (identical or similar elements to those in the T-format connectors according to FIGS. 1 and 2 have the same numerical references). The basic structures resemble those shown in FIGS. 1 and 2, reason why FIGS. 3 and 4 need no further description.

In this text, the word "comprise" and its variants (such as "comprising", etc.) should not be interpreted in an excluding manner, that is to say, they do not exclude the possibility that what is described includes other elements, phases, etc.

On the other hand, the invention is not limited to the specific embodiments described, but also includes, for example, the variants that may be carried out by an average expert in the subject (for example, in terms of the selection of materials, dimensions, components, configuration, etc.) from what is gathered from the claims.

The invention claimed is:

1. High-voltage connector, comprising said connector an insulating body (1, 2) with a first internal channel (3) with a first end (31) and a second end (32), the first internal channel being configured to house a conductor element entering through the first end and extending towards the second end, and a second internal channel (4) with a first end (41), said first end (41) of the second internal channel being configured to receive a bushing or a fixed base of a high-voltage equipment, and said first internal channel (3) in its second end (32) leading into the second internal channel (4), wherein the connector further comprises at least one sensor for measuring an electric feature at least partially embedded inside the insulating body.

2. Connector according to claim 1, wherein said connector is a T format connector, and wherein the second internal channel (4) further comprises a second end (42), said first internal channel (3) in its second end (32) leading into the second internal channel (4) between the first extremity (41) of the second internal channel and the second end (42) of the second internal channel.

3. Connector according to claim 1, in which said at least one measurement sensor (5, 6, 7, 8) is embedded inside the insulating body as a result of a moulding manufacturing process of the insulating body.

4. Connector according to claim 1, in which said at least one measurement sensor has at least one connection point (71, 81) accessible from an external surface of the insulating body to connect the sensor to a device external to the connector.

5. Connector according to claim 1, in which said at least one measurement sensor comprises at least one current sensor (5, 6).

6. Connector according to claim 5, in which said at least one current sensor comprises a coil-shaped current sensor (5) surrounding the second internal channel (4).

7. Connector according to claim 3, in which said at least one current sensor comprises at least a coil-shaped current sensor (6) surrounding the first internal channel (3).

8. Connector according to claim 1, in which said at least one measurement sensor comprises at least one voltage sensor (7, 8).

9. Connector according to claim 8, in which said at least one voltage sensor (7, 8) comprises at least a resistive or capacitive element.

10. Connector according to claim 9, in which said at least one voltage sensor (7, 8) comprises at least two resistive or capacitive elements.

11. Connector according to claim 8, in which said at least one voltage sensor is connected to a connection terminal (9) located inside the connector.

12. Connector according to claim 11, in which said connection terminal (9) is located at a junction area between the first internal channel (3) and the second internal channel (4).

* * * * *